US011261865B2

(12) United States Patent
Ueno

(10) Patent No.: US 11,261,865 B2
(45) Date of Patent: Mar. 1, 2022

(54) SCREW COMPRESSOR HAVING SLIDE VALVE WITH CRESCENT-SHAPED VALVE BODY AND CYLINDRICAL GUIDE PORTION

(71) Applicant: DAIKIN INDUSTRIES, LTD., Osaka (JP)

(72) Inventor: Hiromichi Ueno, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/144,956

(22) Filed: Jan. 8, 2021

(65) Prior Publication Data

US 2021/0131435 A1 May 6, 2021

Related U.S. Application Data

(63) Continuation of application No. PCT/JP2019/024126, filed on Jun. 18, 2019.

(30) Foreign Application Priority Data

Jul. 12, 2018 (JP) ..... JP2018-132103

(51) Int. Cl.
*F04C 18/02* (2006.01)
*F04C 29/12* (2006.01)
(Continued)

(52) U.S. Cl.
CPC ..... *F04C 18/52* (2013.01); *F04C 28/12* (2013.01); *F04C 29/12* (2013.01); *F04C 2240/20* (2013.01)

(58) Field of Classification Search
CPC ..... F04C 18/52; F04C 29/12; F04C 2240/20; F04C 28/12; F04C 28/125
See application file for complete search history.

(56) References Cited

U.S. PATENT DOCUMENTS 4,534,719 A * 8/1985 Zimmern ..... F04C 28/125 418/195
4,610,613 A 9/1986 Szymaszek
(Continued)

FOREIGN PATENT DOCUMENTS

CN 101896725 A 11/2010
GB 1 555 329 A 11/1979
(Continued)

OTHER PUBLICATIONS

International Preliminary Report of corresponding PCT Application No. PCT/JP2019/024126 dated Jan. 21, 2021.
(Continued)

*Primary Examiner* — Essama Omgba
*Assistant Examiner* — Paul W Thiede
(74) *Attorney, Agent, or Firm* — Global IP Counselors, LLP

(57) ABSTRACT

A screw compressor includes screw and gate rotors, a cylindrical wall, and a slide valve including a valve body and a guide portion. The valve body extends in an axial direction of the cylindrical wall and has a crescent shape in a cross section in a perpendicular direction to the axial direction. A radius of curvature of an inner arc shaped curved surface of the crescent shape is substantially equal to a radius of curvature of an inner peripheral surface of the cylindrical wall. A radius of curvature of an outer arc shaped curved surface of the crescent shape is smaller than the radius of curvature of the inner arc shaped curved surface, and a central angle of the outer arc shaped curved surface is 180° or less. The guide portion allows movement of the valve body in the axial direction and restricts movement in the perpendicular direction.

7 Claims, 8 Drawing Sheets

(51) Int. Cl.
*F04C 28/12* (2006.01)
*F04C 18/52* (2006.01)

(56) References Cited

U.S. PATENT DOCUMENTS

| | | | | |
|---|---|---|---|---|
| 2008/0206075 | A1* | 8/2008 | Picouet | F04C 28/12 417/310 |
| 2010/0260620 | A1 | 10/2010 | Miyamura et al. | |
| 2013/0171018 | A1* | 7/2013 | Inoue | F04C 28/12 418/191 |

FOREIGN PATENT DOCUMENTS

| | | | |
|---|---|---|---|
| GB | 2 119 856 | A | 11/1983 |
| JP | 5-157072 | A | 6/1993 |
| JP | 7-6509 | A | 1/1995 |
| JP | 2014-44708 | A | 3/2014 |
| JP | 5790452 | B2 | 10/2015 |

OTHER PUBLICATIONS

International Search Report of corresponding PCT Application No. PCT/JP2019/024126 dated Sep. 17, 2019.
Written Opinion of the International Searching Authority corresponding PCT Application No. PCT/JP2019/024126 dated Sep. 17, 2019.
European Search Report of corresponding EP Application No. 19 83 5101.7 dated Mar. 26, 2021.

* cited by examiner

SCREW COMPRESSOR HAVING SLIDE VALVE WITH CRESCENT-SHAPED VALVE BODY AND CYLINDRICAL GUIDE PORTION

CROSS-REFERENCE TO RELATED APPLICATIONS

This is a continuation of International Application No. PCT/JP2019/024126 filed on Jun. 18, 2019, which claims priority to Japanese Patent Application No. 2018-132103 filed on Jul. 12, 2018. The entire disclosures of these applications are incorporated by reference herein.

BACKGROUND

Field of Invention

The present disclosure relates to a screw compressor.

Background Information

Examples of screw compressors include a single screw compressor including a screw rotor and a gate rotor (see, for example, Japanese Patent No. 5790452). The screw rotor is rotatably inserted into a cylindrical wall disposed at a central part of a casing. The screw rotor has a helical screw groove, and a fluid chamber is formed because gates of the gate rotor mesh with the screw groove. The casing has a low-pressure chamber and a high-pressure chamber formed therein. A fluid in the low-pressure chamber is sucked into the fluid chamber and compressed when the screw rotor rotates, and the compressed fluid is discharged to the high-pressure chamber.

The screw compressor includes a slide valve. The cylindrical wall has an opening, and the slide valve is slidably attached to the casing so as to adjust the opening area of the opening.

SUMMARY

A first aspect of the present disclosure is directed to a screw compressor including a screw rotor; a gate rotor that meshes with the screw rotor; a cylindrical wall into which the screw rotor is rotatably inserted; and a slide valve configured to adjust an opening area of an opening formed in the cylindrical wall, the slide valve including a valve body and a guide portion. The valve body extends in an axial direction of the cylindrical wall and has a crescent shape in a cross section in a perpendicular direction that is perpendicular to the axial direction. A radius of curvature of an inner arc shaped curved surface of the crescent shape is substantially equal to a radius of curvature of an inner peripheral surface of the cylindrical wall. A radius of curvature of an outer arc shaped curved surface of the crescent shape is smaller than the radius of curvature of the inner arc shaped curved surface, and a central angle of the outer arc shaped curved surface is smaller than or equal to 180°. The guide portion is configured to allow movement of the valve body in the axial direction and restrict movement of the valve body in the perpendicular direction. The guide portion has a cylindrical shape and a center thereof being disposed at a position that is displaced from a center of curvature of the outer arc shaped curved surface of the valve body.

DETAILED DESCRIPTION OF EMBODIMENT(S)

Hereafter, an embodiment will be described with reference to the drawings.

Figure 1:
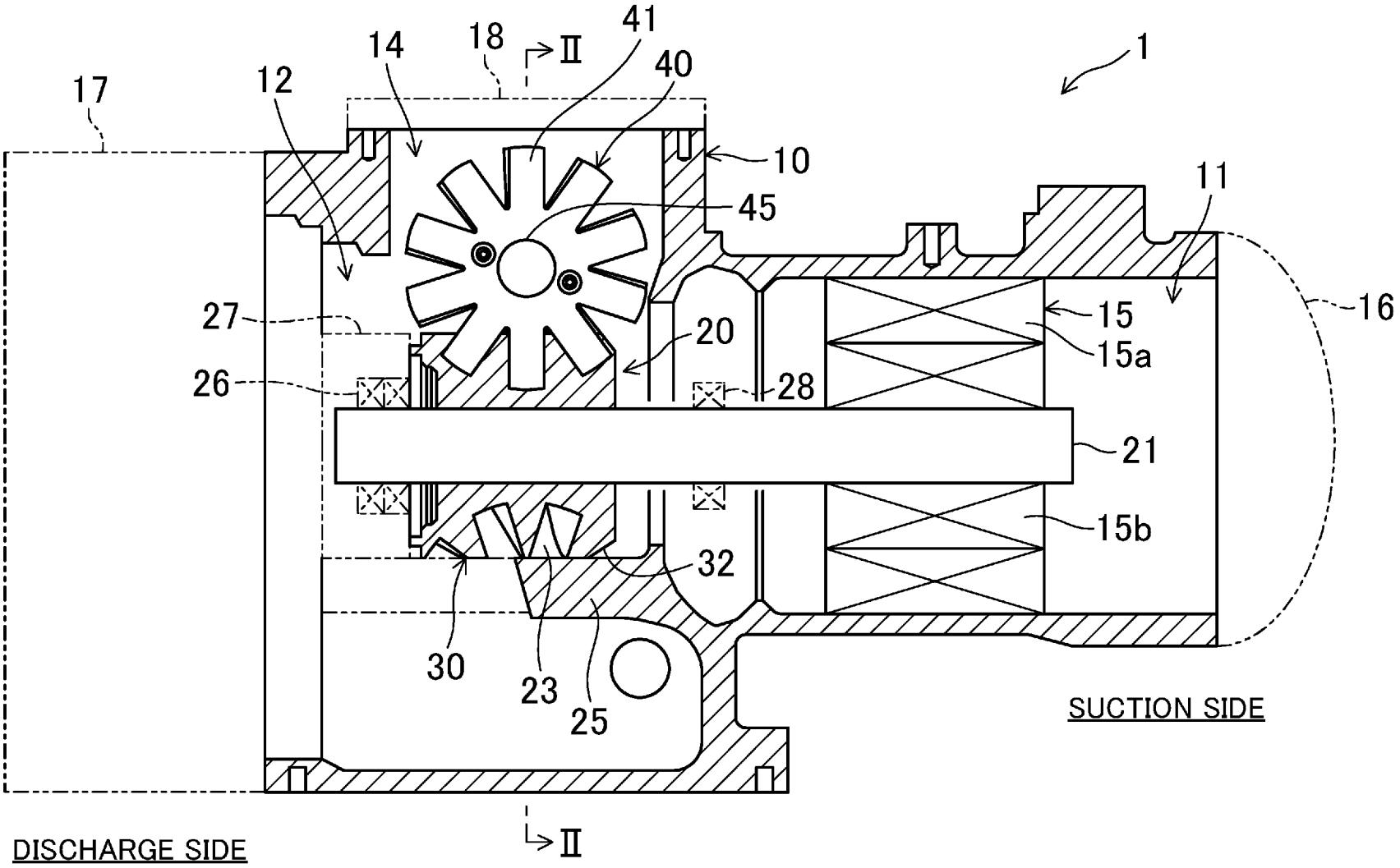
FIG. 1 is a longitudinal sectional view of a screw compressor according to an embodiment (a sectional view taken along line I-I of FIG. 2).
Figure 2:
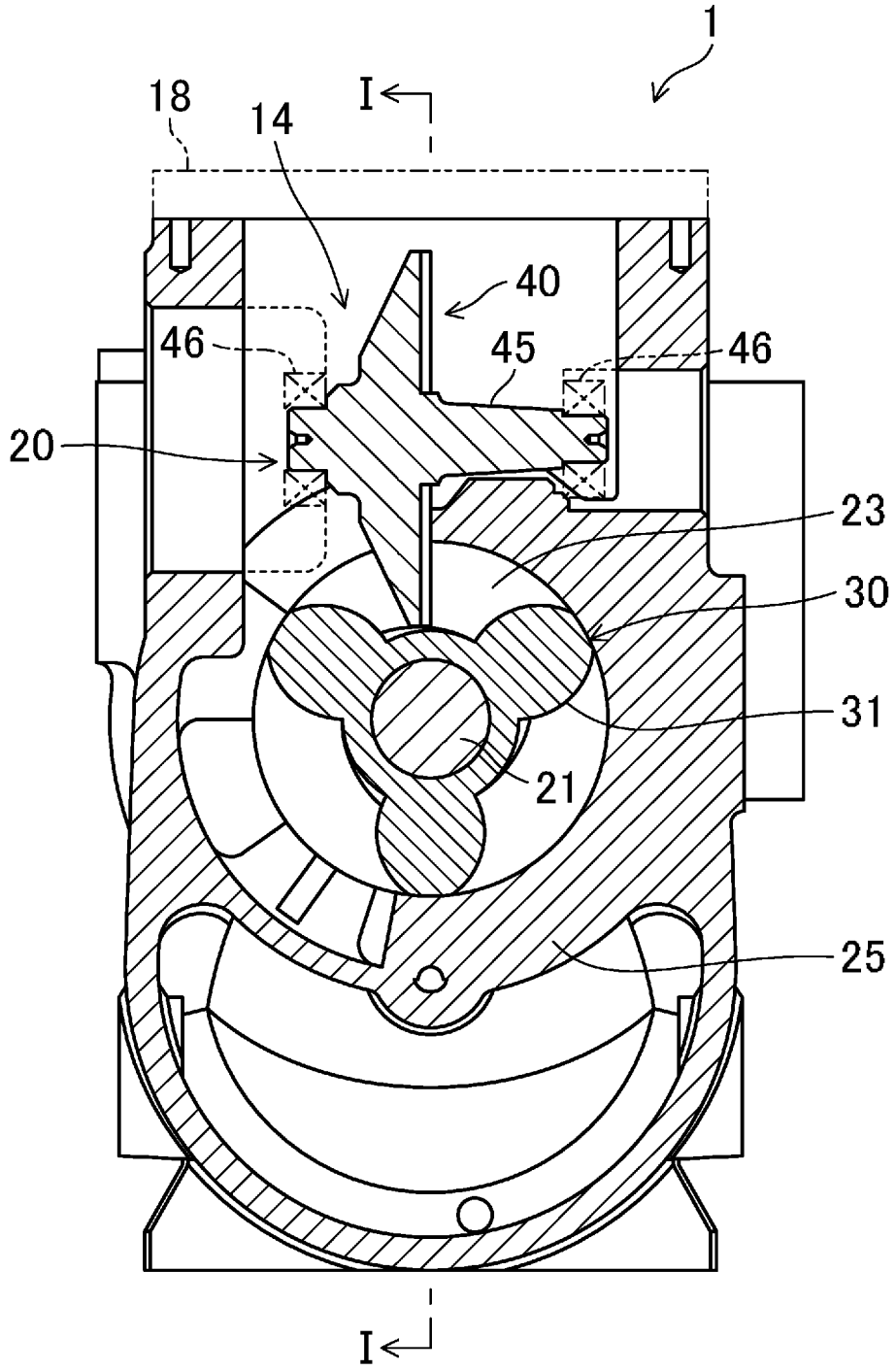
FIG. 2 is a sectional view taken along line II-II of FIG. 1.

A screw compressor (1) according to the present embodiment illustrated in FIGS. 1 and 2 is used for refrigeration and air-conditioning, is disposed in a refrigerant circuit that performs a refrigeration cycle, and compresses a refrigerant. The screw compressor (1) includes a hollow casing (10) and a compression mechanism (20).

The casing (10) accommodates, at substantially the center of the inside thereof, the compression mechanism (20) that compresses a low-pressure refrigerant. A low-pressure chamber (11) on the suction side and a high-pressure chamber (12) on the discharge side are divisionally formed in the casing (10) with the compression mechanism (20) therebetween. A low-pressure gas refrigerant is introduced into the low-pressure chamber (11) from an evaporator (not shown) of the refrigerant circuit, and the low-pressure chamber (11) guides the low-pressure gas to the compression mechanism (20). A high-pressure gas refrigerant discharged from the compression mechanism (20) flows into the high-pressure chamber (12).

An inverter-controlled motor (15), which rotates a rotor (15*b*) in a stator (15*a*), is fixed in the casing (10). The motor (15) and the compression mechanism (20) are coupled to each other via a drive shaft (21) that is a rotation shaft. A bearing holder (27) is disposed in the casing (10). An end portion of the drive shaft (21) on the discharge side is supported by a bearing (26) attached to the bearing holder (27), and a middle portion of the drive shaft (21) is supported by a bearing (28).

The compression mechanism (20) includes a cylindrical wall (25) formed in the casing (10), one screw rotor (30) disposed in the cylindrical wall (25), and one gate rotor (40) that meshes with the screw rotor (30). The screw rotor (30) is attached to the drive shaft (21), and a key (not shown) prevents the screw rotor (30) from rotating relative the drive shaft (21). Thus, the screw compressor (1) according to the present embodiment is a so-called one-gate-rotor single screw compressor in which the screw rotor (30) and the gate rotor (40) are disposed in one-to-one correspondence with each other in the casing (10).

The cylindrical wall (25) is formed in a central part of the casing (10) to have a predetermined thickness, and the screw rotor (30) is rotatably inserted into the cylindrical wall (25). One side (the right end in FIG. 1) of the cylindrical wall (25) faces the low-pressure chamber (11), and the other side (the left end in FIG. 1) of the cylindrical wall (25) faces the high-pressure chamber (12). The cylindrical wall (25) is not formed around the entire periphery of the screw rotor (30), and an end surface on the high-pressure side is inclined in accordance with the direction in which screw grooves (31) (described below) are twisted.

Figure 4:
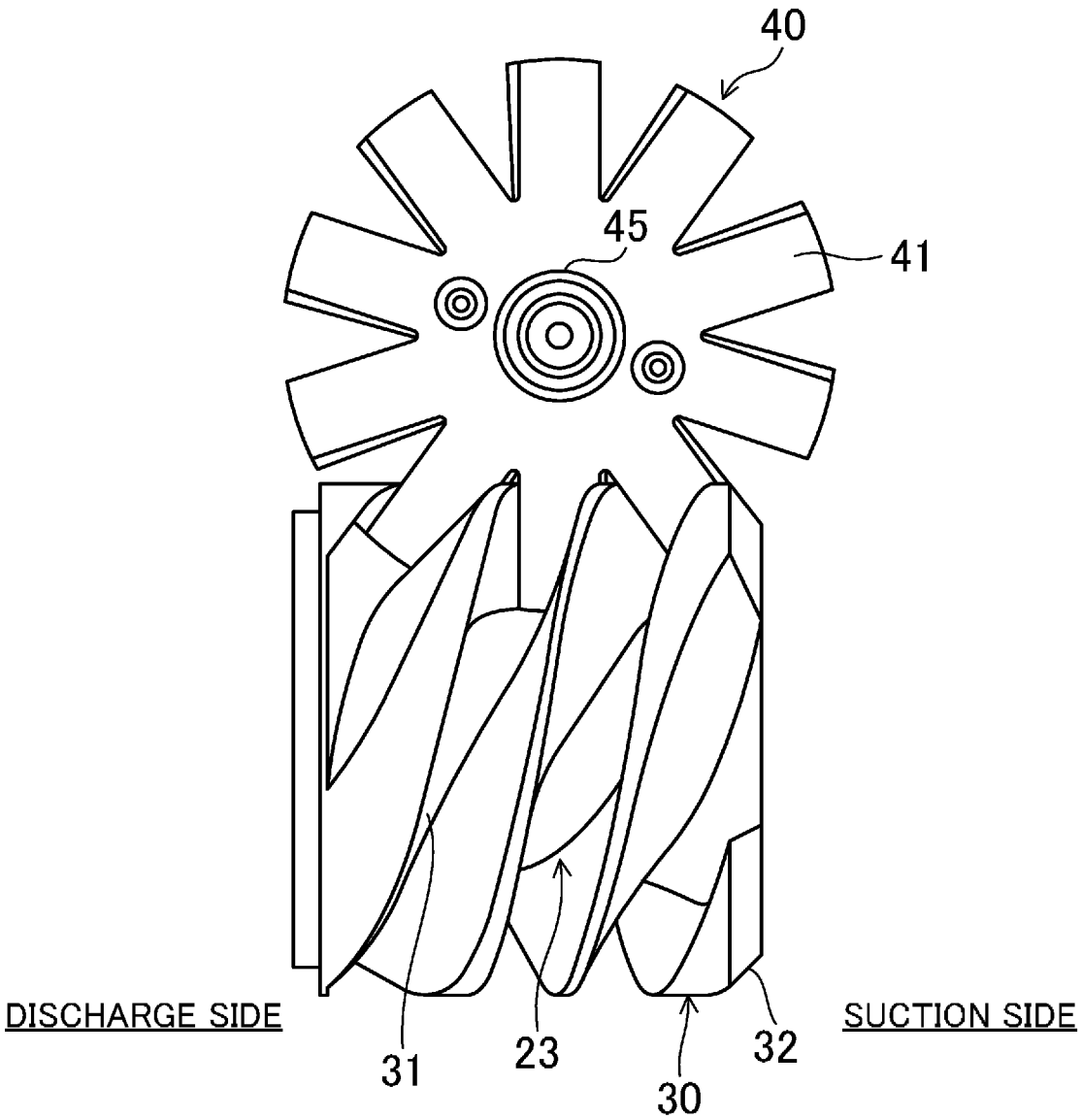
FIG. 4 is an external view illustrating a state in which a screw rotor and a gate rotor mesh with each other.
Figure 5:
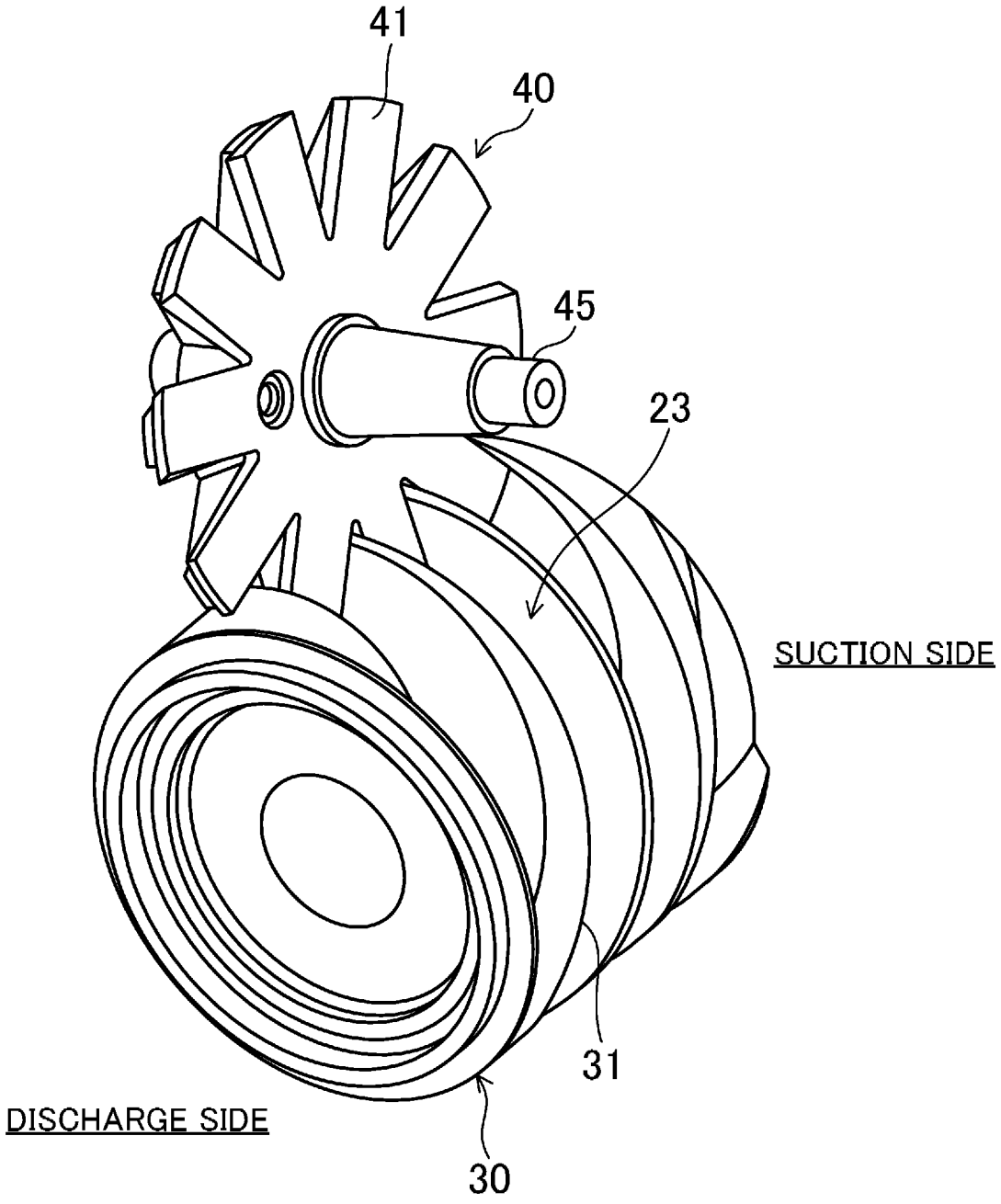
FIG. 5 is a perspective view illustrating a state in which the screw rotor and the gate rotor mesh with each other.

As illustrated in FIGS. 4 and 5, a plurality of (in the present embodiment, three) helical screw grooves (31) are formed in the outer peripheral surface of the screw rotor (30). The screw rotor (30) is rotatably fitted into the cylindrical wall (25), and the outer peripheral surfaces of the teeth of the screw rotor (30) are surrounded by the cylindrical wall (25).

The gate rotor (40) has a disk-like shape having a plurality of (in the present embodiment, ten) gates (41) that are disposed radially. The axis of the gate rotor (40) is disposed in a plane that is perpendicular to the axis of the screw rotor (30). The gates (41) of the gate rotor (40) are configured to extend through a part of the cylindrical wall (25) and mesh with the screw grooves (31) of the screw rotor (30). The screw rotor (30) is made of a metal, and the gate rotor (40) is made of a synthetic resin.

The gate rotor (40) is disposed in a gate rotor chamber (14) that is divisionally formed in the casing (10). A driven shaft (45), which is a rotation shaft, is coupled to the center of the gate rotor (40). The driven shaft (45) is rotatably supported by a bearing (46) that is disposed in the gate rotor chamber (14). The bearing (46) is held by the casing (10) via a bearing housing.

A suction cover (16) is attached to an end surface of the casing (10) on the low-pressure chamber (11) side, and a discharge cover (17) is attached to an end surface of the casing (10) on the high-pressure chamber (12) side. The gate rotor chamber (14) of the casing (10) is covered with a gate rotor cover (18).

In the compression mechanism (20), a space surrounded by the inner peripheral surface of the cylindrical wall (25) and the screw grooves (31) of the screw rotor (30) is a fluid chamber (23) that serves as either of a suction chamber and a compression chamber (hereafter, the numeral (23) will be used for both of the compression chamber and the fluid chamber). Regarding the screw rotor (30), a right end portion in FIGS. 1, 4, and 5 is the suction side, and a left end portion is the discharge side. An outer peripheral part of a suction-side end portion (32) of the screw rotor (30) is tapered. The screw grooves (31) of the screw rotor (30) open in the low-pressure chamber (11) at the suction-side end portion (32), and the open part is a suction opening of the compression mechanism (20).

In the compression mechanism (20), the gates (41) of the gate rotor (40) move relative to the screw grooves (31) of the screw rotor (30) as the screw rotor (30) rotates, and thus the fluid chamber (23) repeatedly expands and contracts. Thus, a suction step of sucking a refrigerant, a compression step of compressing the refrigerant, and a discharge step of discharging the refrigerant are performed successively and repeatedly.

Figure 3:
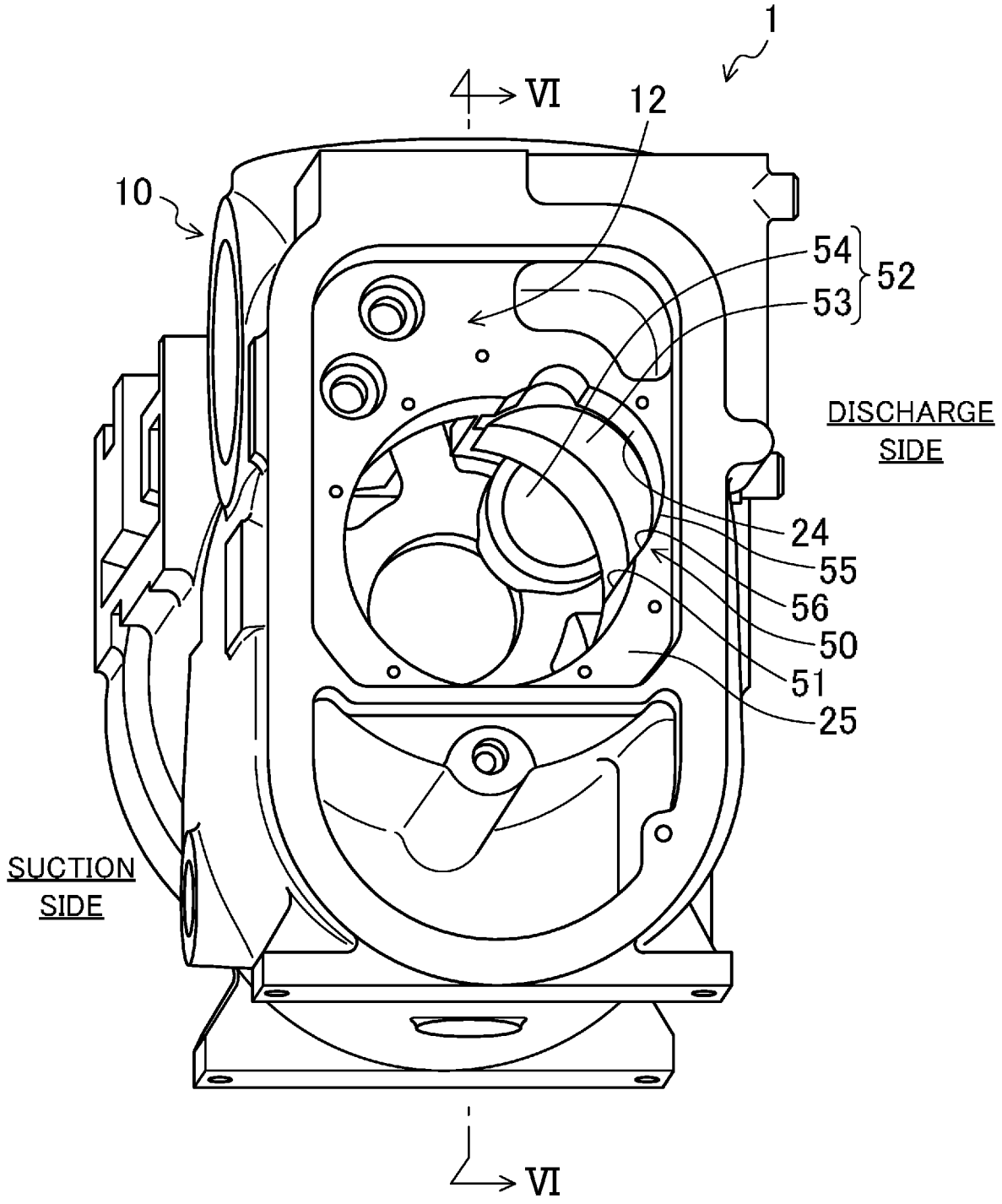
FIG. 3 is a perspective view of a casing of the screw compressor of FIG. 1 as seen from an end surface on the discharge side.
Figure 6:
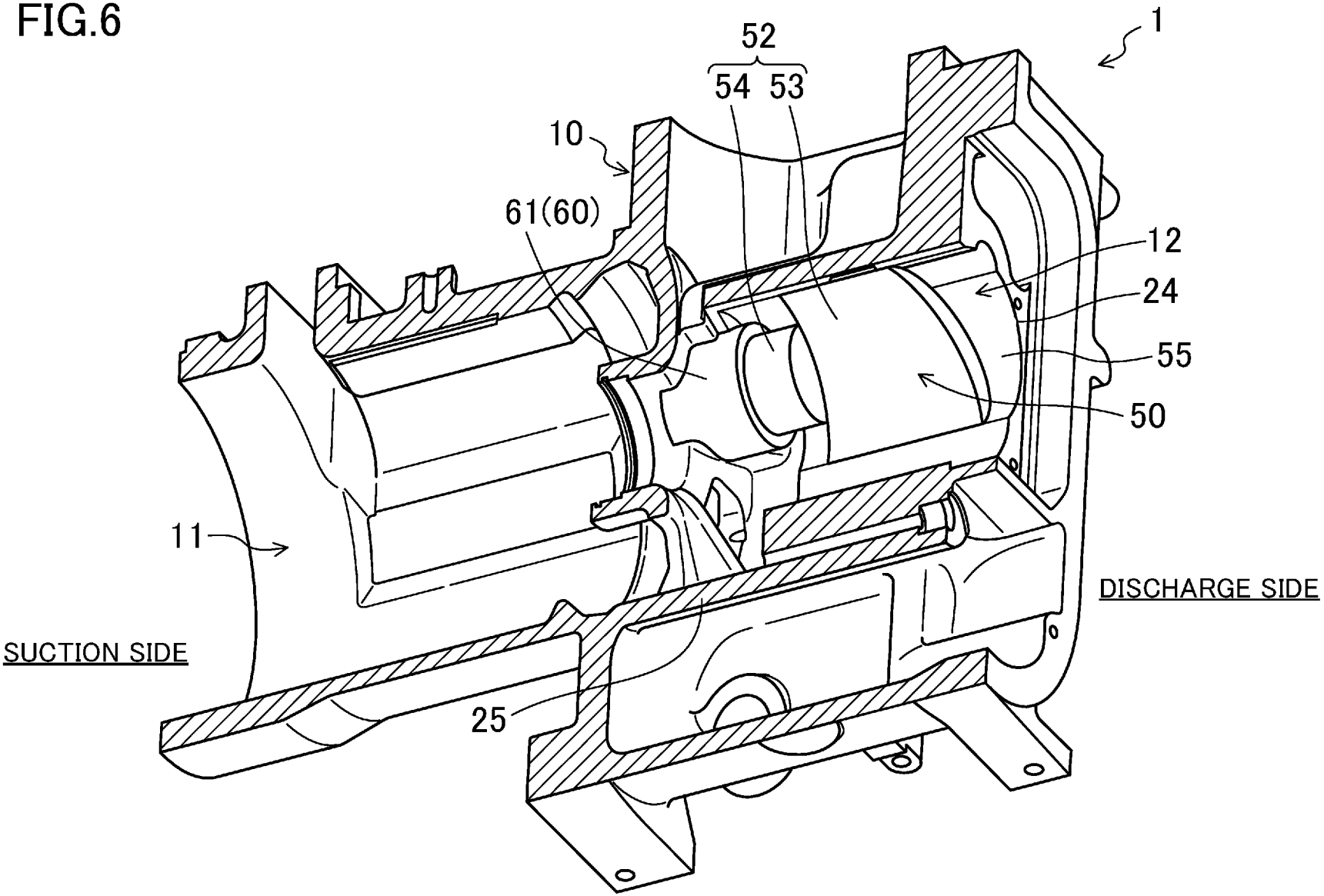
FIG. 6 is a perspective sectional view taken along line VI-VI of FIG. 3.
Figure 7:
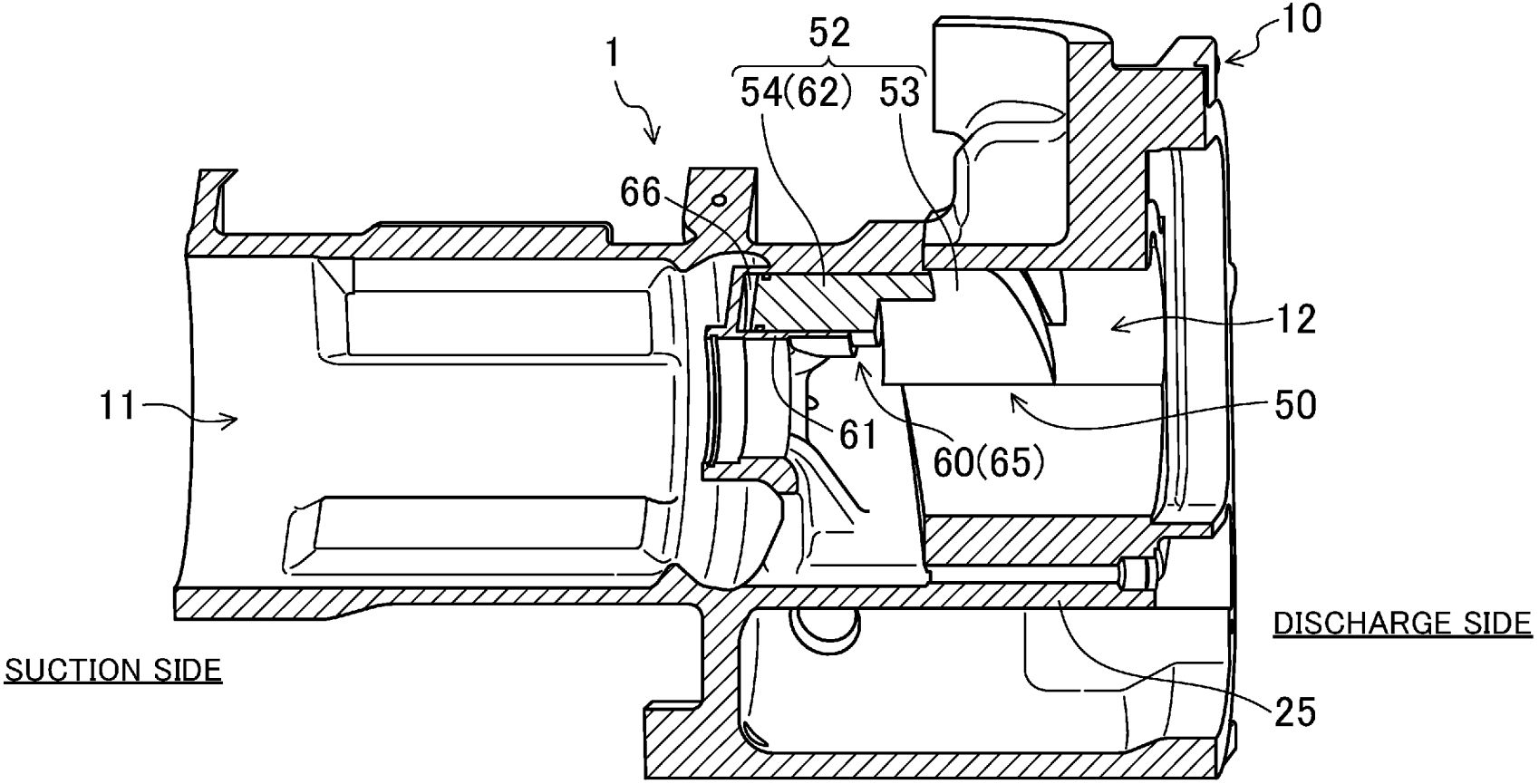
FIG. 7 is a sectional view of the casing taken along a plane passing through the center of the slide valve.

As illustrated in FIG. 3, which is a perspective view of the casing (10) as seen from the discharge side, and FIG. 6, which is a sectional view taken along line VI-VI of FIG. 3, the screw compressor (1) includes a valve adjustment mechanism (50). The valve adjustment mechanism (50) includes a slide valve (52) for controlling the internal volume ratio (the ratio of the discharge volume to the suction volume of the compression mechanism (20)) by adjusting a timing at which the fluid chamber (23) serving as the compression chamber communicates with a discharge port (24). FIG. 7 is a sectional view of the casing taken along a plane passing through the center of the slide valve.

As illustrated in FIGS. 3, 6, and 7, in the present embodiment, the valve adjustment mechanism (50) is disposed at one position in the casing (10). The valve adjustment mechanism (50) is a mechanism that adjusts the opening area of an opening (51) that is formed in the cylindrical wall (25) so as to communicate with the compression chamber (23) that is formed as the gates (41) mesh with the screw grooves (31). The opening (51) is a discharge port of the compression mechanism (20) in the present embodiment.

Figure 8:
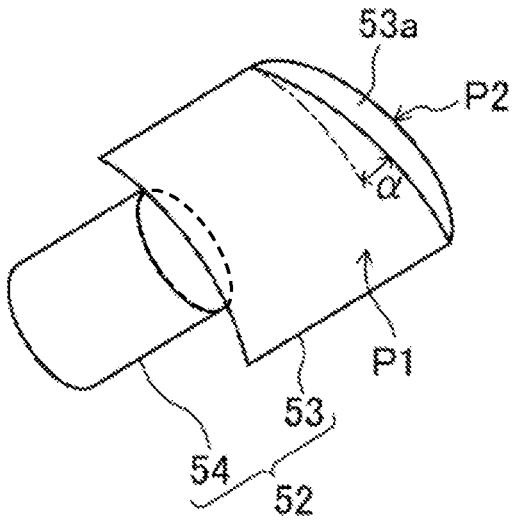
FIG. 8 is an external perspective view of the slide valve.
Figure 9:
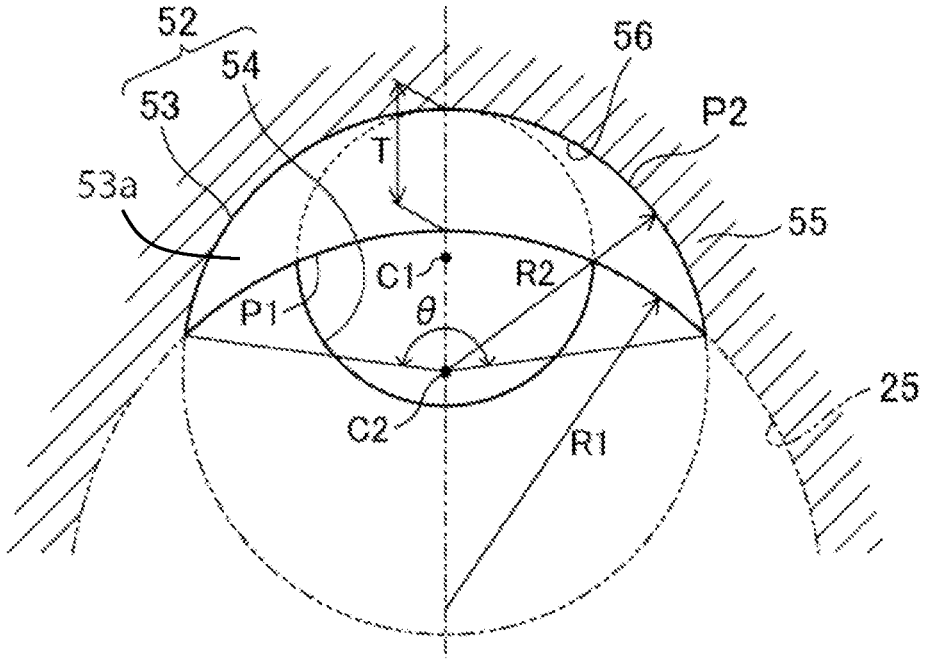
FIG. 9 is a side view of the slide valve as seen from an end surface on the valve body side.

The slide valve (52) includes a valve body (53) and a guide portion (54). As illustrated in FIG. 8, which is an external perspective view, and FIG. 9, which is a side view as seen from an end surface on the valve body (53) side, the slide valve (52) is a member in which the valve body (53) that is a part having a crescent cross-sectional shape and the guide portion (54) that is a part having a cylindrical shape are integrally formed.

A cylinder (61), into which the guide portion (54) is fitted so as to be slidable in the axial direction, is formed in the casing (10). The valve body (53) slides in the axial direction, and thus the opening area of the opening (51) is adjusted. A valve accommodation portion (55), which accommodates the valve body (53) so as to be slidable in the axial direction, is formed in the casing (10). The valve accommodation portion (55) is a concave portion extending in the axial direction of the cylindrical wall (25) of the casing (10). Apart of the valve accommodation portion (55) facing the screw rotor (30) is open, and the open part is the opening (51). The valve accommodation portion (55) includes a curved wall (56) that protrudes from the cylindrical wall (25) outward in the radial direction of the screw rotor (30) in a shape having an arc-shaped cross section and that extends in the axial direction of the screw rotor (30).

The valve body (53) extends in the axial direction of the cylindrical wall (25), and as described above, has a crescent shape in a cross section in a perpendicular direction that is perpendicular to the axial direction. The crescent shape is defined as follows. To be specific, the radius of curvature (first radius of curvature (R1)) of an inner arc-like curved surface (first arc-like curved surface (P1)) of the crescent shape is substantially equal to the radius of curvature of an inner peripheral surface of the cylindrical wall (25). The radius of curvature (second radius of curvature (R2)) of an outer arc-like curved surface (second arc-like curved surface (P2)) of the crescent shape is smaller than the first radius of curvature (R1), and the central angle (θ) of the outer arc-like curved surface (P2) is smaller than or equal to 180°. The valve body (53) has a thickness, which is denoted by T in the figure, along a line connecting the center of the outer arc-like curved surface (P2) and the center of the inner arc-like curved surface (P1) (along a radial line of the screw rotor (30)). The dimension (T) of the valve body (53) is as small as about a half of the diameter of the guide portion (54).

The center of curvature (second center (C2)) of the second arc-like curved surface (P2) of the valve body (53) is disposed at a position that is displaced toward the center of the screw rotor (30) from the center (first center (C1)) of the cylindrical guide portion (54). The entirety of the guide portion (54) is positioned inside in a radial direction with respect to the second arc-like curved surface (P2), and does not protrude outward from the second arc-like curved surface (P2). To be specific, the position of an outer end of the second arc-like curved surface (P2) and the position of an outer end of the outer peripheral surface of the guide portion (54) in the radial direction of the screw rotor (30) are the same. Moreover, the area of an end surface of the guide portion (54) is larger than the area of the crescent shape of the valve body (53).

The second arc-like curved surface (P2) of the valve body (53) of the slide valve (52) slides along the curved wall (56) of the valve accommodation portion (55), and the first arc-like curved surface (P1) of the valve body (53) slides along the outer peripheral surface of the screw rotor (30). The guide portion (54) is fitted into the cylinder (61), and the second center (C2) and the first center (C1) are displaced from each other. Owing to the above configuration, the valve adjustment mechanism (50) allows movement of the valve body (53) in the axial direction and restricts movement of the valve body (53) in the perpendicular direction. Rotation of the slide valve (52) along a sliding surface between the second arc-like curved surface (P2) and the curved wall (56) of the valve accommodation portion (55) is restricted.

The valve body (53) has a high-pressure-side end surface (53*a*) facing a channel through which a high-pressure fluid compressed in the compression chamber (23) flows out to a discharge path (not shown) in the casing (10) (see FIG. 8). In FIG. 8, the inclination ($\alpha$) of the high-pressure-side end surface (53*a*) with respect to a line perpendicular to the axis of the valve body (53) is substantially the same as the inclination of the screw grooves (31).

As described above, the screw rotor (30) is inserted into the cylindrical wall (25), and thus the fluid chamber (23), whose suction side is one end side of the cylindrical wall (25) and whose discharge end is the other end side of the cylindrical wall (25), is formed in the casing (10). As illustrated in FIG. 7, the guide portion (54) is disposed on the suction side of the fluid chamber with respect to the valve body (53).

As schematically illustrated in FIG. 7, the screw compressor (1) includes a slide-valve drive mechanism (60) that drives the slide valve (52). The slide-valve drive mechanism (60) is constituted by a hydraulic cylinder mechanism (65) including the cylinder (61) integrally formed with the casing (10) and a piston (62) that is accommodated in the cylinder (61) and that reciprocates in the cylinder (61).

In the hydraulic cylinder mechanism (65), the guide portion (54) is used as the piston (62). Although details are omitted, the slide-valve drive mechanism (60) is configured to move the piston (62) and the slide valve (52) from the suction side toward the discharge side by using the difference between a driving force in a low-pressure direction that is generated by high pressure acting on the area of the high-pressure-side end surface (53*a*) of the crescent shape of the valve body (53) and a driving force in a high-pressure direction that is generated by high pressure of a fluid, which is introduced into a cylinder chamber (66) between the cylinder (61) and the piston (62), acting on the piston (62). For this purpose, the area of the end surface of the piston (62) is set larger than the area of the high-pressure-side end surface (53*a*).

When the position of the slide valve (52) is adjusted, the position of the high-pressure-side end surface (53*a*), which faces a channel through which a high-pressure refrigerant compressed in the compression chamber (23) flows out to the discharge path in the casing (10), changes, and therefore the opening area of the opening (51), which is a discharge port formed in the cylindrical wall (25) of the casing (10), changes. Thus, a timing at which the screw grooves (31) communicate with the discharge port while the screw rotor (30) rotates changes, and therefore the internal volume ratio of the compression mechanism (20) is adjusted.

Operation

Next, the operation of the screw compressor (1) will be described.

When the motor (15) of the screw compressor (1) is started, the screw rotor (30) rotates as the drive shaft (21) rotates. The gate rotor (40) rotates as the screw rotor (30) rotates, and the compression mechanism (20) repeats a cycle of a suction step, a compression step, and a discharge step.

In the compression mechanism (20), the screw rotor (30) rotates, and thus the volume of the fluid chamber (23) of the screw compressor (1) increases and then decreases as the screw grooves (31) and the gates (41) move relative to each other.

While the volume of the fluid chamber (23) is increasing, a low-pressure gas refrigerant in the low-pressure chamber (11) is sucked into the fluid chamber (23) through the suction opening (suction step). As the screw rotor (30) rotates further, the gates (41) of the gate rotor (40) divisionally form the compression chamber (23) that is separated from the low-pressure side, and then the volume of the compression chamber (23) stops increasing and starts decreasing. While the volume of the compression chamber (23) is decreasing, the sucked refrigerant is compressed (compression step). The compression chamber (23) moves as the screw rotor (30) rotates further, and subsequently the discharge-side end portion of the compression chamber (23) communicates with the discharge opening. When the discharge-side end portion of the compression chamber (23) opens and communicates with the discharge opening in this way, a high-pressure gas refrigerant is discharged from the compression chamber (23) to the high-pressure chamber (12) (discharge step).

With the valve adjustment mechanism (50), when the position of the slide valve (52) is adjusted, the opening area of the opening (discharge port) (51), which is formed in the cylindrical wall (25) of the casing (10), changes. Due to the change in the area, the ratio of the discharge volume to the suction volume changes, and the internal volume ratio of the compression mechanism (20) is adjusted.

Advantageous Effects of Embodiment

In the present embodiment, the valve body (53) of the slide valve (52) extends in the axial direction of the cylindrical wall (25) and has a crescent shape in a cross section in a perpendicular direction that is perpendicular to the axial direction. The radius of curvature (R1) of an inner arc-like curved surface (P1) of the crescent shape is substantially equal to a radius of curvature of the inner peripheral surface of the cylindrical wall (25), the radius of curvature (R2) of an outer arc-like curved surface (P2) of the crescent shape is smaller than the radius of curvature (R1) of the inner arc-like curved surface (P1), and the central angle ($\theta$) of the outer arc-like curved surface (P2) is smaller than or equal to 180°. The guide portion (54) is configured to allow movement of the valve body (53) in the axial direction and restrict movement of the valve body (53) in the perpendicular direction.

Existing screw compressors have a drawback in that, when the slide valve is enlarged to increase the size of the discharge port, the thickness (T) of the screw rotor (30) in the radial direction in the valve body (53) is increased, and thus the size of the compression mechanism (20) may increase, the rigidity of the casing (10) may decrease, and the dimensional precision may decrease due to deformation of the casing (10) when a pressure is applied.

In contrast, with the present embodiment, the valve body (53) has a crescent shape in a cross section, and the radius of curvature of the outer arc-like curved surface (P2) of the crescent shape is smaller than the radius of curvature (R1) of the inner arc-like curved surface (P1), which is substantially equal to the radius of curvature of the inner peripheral surface of the cylindrical wall (25), and the central angle (θ) of the outer arc-like curved surface (P2) is smaller than or equal to 180°. Therefore, even when the opening area of the opening (51) of the cylindrical wall (25) is increased, the thickness (T) of the valve body (53) along a line connecting the center of the outer arc-like curved surface (P2) and the center of the inner arc-like curved surface (P1) (along a radial line of the screw rotor (30)) is smaller than that of the valve body of existing slide valves, in which the central angle (θ) is larger than 180°. Accordingly, increase in size of the casing (10) of the screw compressor (1) is restricted, and pressure loss on the discharge side can be reduced without increasing the size of the slide valve (52).

It may be conceivable that the thickness (T) can be reduced by dividing the slide valve (52) into a plurality of members. However, if the slide valve (52) is divided into a plurality of members, it becomes difficult to machine the slide valve (52), and thus the manufacturing cost may increase and the dimensional precision may decrease. With the present embodiment, because the guide portion (54) is short, it is easy to increase the positional precision of the valve body (53) and the guide portion (54).

In the present embodiment, the guide portion (54) has a cylindrical shape and the center (C1) thereof is disposed at a position that is displaced from the center of curvature (C2) of the outer arc-like curved surface (P2) of the valve body (53). The entirety of the guide portion (54) is positioned inside in a radial direction with respect to the outer arc-like curved surface (P2) of the valve body (53). Moreover, the thickness (T) of the valve body (53) is smaller than the diameter of the guide portion (54).

With the present embodiment, because the center (C1) of the guide portion (54) is displaced from the center of curvature (C2) of the outer arc-like curved surface (P2) of the valve body (53), rotation of the valve body (53) along the outer arc-like curved surface (P2) is suppressed; and interference of the inner arc-like curved surface (P1) with the outer peripheral surface of the screw rotor (30) can be suppressed. Moreover, because the entirety of the guide portion (54) is positioned inside in the radial direction with respect to the outer arc-like curved surface (P2) of the valve body (53) and the thickness (T) of the valve body (53) is smaller than the diameter of the guide portion (54), the size of the compression mechanism (20) and the size of the screw compressor (1) can be effectively reduced.

In the present embodiment, the slide-valve drive mechanism (60) is constituted by the hydraulic cylinder mechanism (65) including the cylinder (61) and the piston (62) that is accommodated in the cylinder (61) and that reciprocates in the cylinder (61), and the piston (62) is constituted by the guide portion (54). Thus, the configuration of the slide-valve drive mechanism (60) can be simplified by using the guide portion (54) of the slide valve (52) as the piston (62) of the hydraulic cylinder mechanism (65). Moreover, in the present embodiment, the guide portion (54) is disposed on the suction side of the fluid chamber (23) with respect to the valve body (53), and it is not necessary to dispose a member for driving the slide valve (52) on the discharge side. Therefore, in the present embodiment, resistance on the discharge side can be reduced, which is effective in reduction of pressure loss.

OTHER EMBODIMENTS

The embodiment described above may be modified as follows.

For example, in the embodiment, the screw compressor (1) having only one gate rotor (40) for one screw rotor (30) has been described as an example. However, the screw compressor may have a plurality of gate rotors.

In the embodiment, rotation of the slide valve (52) is stopped by displacing the center of the guide portion (54) from the center of the outer arc-like curved surface (P2) of the valve body (53). However, these centers need not be displaced from each other, provided that another rotation stopping mechanism is disposed.

In the embodiment, the thickness (T) of the crescent shape of the valve body (53) is about a half of the diameter of the guide portion (54). However, the thickness and the diameter need not have this relationship and may be changed as appropriate. The positional relationship between the guide portion (54) and the valve body (53) may also be changed as appropriate.

In the embodiment, the hydraulic cylinder mechanism (65) that uses the guide portion (54) as the piston (62) is used as the slide-valve drive mechanism (60). However, the configuration of the slide-valve drive mechanism (60) may be changed as appropriate. The slide-valve drive mechanism (60) may be disposed at a position on the high-pressure side of the valve body (53) instead of a position on the low-pressure side.

In the embodiment, the slide valve (52) is used as a mechanism that adjusts the internal volume ratio of the compression mechanism (20) of the screw compressor (1) that performs volume control by inverter control. However, for example, in a screw compressor that does not perform volume control by inverter control, the slide valve (52) may be used as an unload mechanism that adjusts the operating volume by returning a part of a fluid that is being compressed in the compression chamber (23) to the low-pressure side.

The embodiment and modifications that have been described may be changed in configuration and details in various ways within the sprit and scope of the claims. The embodiment and modifications may be combined or replaced as appropriate, provided that the functions of the object of the present disclosure are not impaired.

As heretofore described, the present disclosure is applicable to a screw compressor.

The invention claimed is:

1. A screw compressor comprising:

a screw rotor;

a gate rotor that meshes with the screw rotor;

a cylindrical wall in which the screw rotor is rotatably disposed; and a slide valve configured to adjust an opening area of an opening formed in the cylindrical wall, the slide valve including a valve body and a guide portion, the valve body extending in an axial direction of the cylindrical wall and having a crescent shape in a cross section in a perpendicular direction that is perpendicular to the axial direction, a radius of curvature of an inner arc shaped curved surface of the crescent shape being substantially equal to a radius of curvature of an inner peripheral surface of the cylindrical wall when viewed in an axial direction of the slide valve, a radius of curvature of an outer arc shaped curved surface of the crescent shape being smaller than the radius of curvature of the inner arc shaped curved surface, and a central angle of the outer arc shaped curved surface being smaller than or equal to 180° when viewed in the axial direction of the slide valve, the guide portion being configured to allow movement of the valve body in the axial direction and restrict movement of the valve body in the perpendicular direction, and the guide portion having a cylindrical shape and a center thereof being disposed at a position that is spaced from a center of curvature of the outer arc shaped curved surface of the valve body when viewed in the axial direction of the slide valve, the guide portion extending beyond the inner arc shaped curved surface of the valve body in a radial direction.

2. The screw compressor according to claim 1, wherein the guide portion does not extend beyond in a radial direction the outer arc shaped curved surface of the valve body.

3. The screw compressor according to claim 2, further comprising:

a slide-valve drive mechanism that drives the slide valve, the slide-valve drive mechanism including a hydraulic cylinder mechanism including a cylinder and a piston that is accommodated in the cylinder and that reciprocates in the cylinder, and the piston being formed by the guide portion.

4. The screw compressor according to claim 2, wherein the disposed screw rotor relative to the cylindrical wall defines a fluid chamber, the fluid chamber having a suction side that is at a first axial end of the cylindrical wall and a discharge side that is at a second axial end of the cylindrical wall opposite the first axial end, and the guide portion is disposed on the suction side of the fluid chamber with respect to the valve body.

5. The screw compressor according to claim 1, further comprising:

a slide-valve drive mechanism that drives the slide valve, the slide-valve drive mechanism including a hydraulic cylinder mechanism including a cylinder and a piston that is accommodated in the cylinder and that reciprocates in the cylinder, and the piston being formed by the guide portion.

6. The screw compressor according to claim 5, wherein the disposed screw rotor relative to the cylindrical wall defines a fluid chamber, the fluid chamber having a suction side that is at a first axial end of the cylindrical wall and a discharge side that is at a second axial end of the cylindrical wall opposite the first axial end, and the guide portion is disposed on the suction side of the fluid chamber with respect to the valve body.

7. The screw compressor according to claim 1, wherein the disposed screw rotor relative to the cylindrical wall defines a fluid chamber, the fluid chamber having a suction side that is at a first axial end of the cylindrical wall and a discharge side that is at a second axial end of the cylindrical wall opposite the first axial end, and the guide portion is disposed on the suction side of the fluid chamber with respect to the valve body.

* * * * *